US008790128B2

(12) United States Patent
Andresen

(10) Patent No.: US 8,790,128 B2
(45) Date of Patent: Jul. 29, 2014

(54) ELECTRIC DISTRIBUTOR DEVICE

(75) Inventor: Jens Andresen, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/515,125

(22) PCT Filed: Jun. 6, 2011

(86) PCT No.: PCT/EP2011/059313

§ 371 (c)(1),
(2), (4) Date: Jun. 11, 2012

(87) PCT Pub. No.: WO2011/154365

PCT Pub. Date: Dec. 15, 2011

(65) Prior Publication Data

US 2013/0072050 A1 Mar. 21, 2013

(30) Foreign Application Priority Data

Jun. 7, 2010 (DE) ..... 10 2010 017 266

(51) Int. Cl.

| | |
|---|---|
| ***H01R 4/24*** | (2006.01) |
| ***H01R 13/622*** | (2006.01) |
| ***H01R 9/03*** | (2006.01) |
| ***H01R 33/97*** | (2006.01) |
| *H01R 13/59* | (2006.01) |
| *H01R 13/52* | (2006.01) |
| *H01R 13/11* | (2006.01) |

(52) U.S. Cl.

CPC ..... *H01R 33/971* (2013.01); *H01R 13/622* (2013.01); *H01R 13/59* (2013.01); *H01R 9/031* (2013.01); *H01R 13/5208* (2013.01); *H01R 4/2433* (2013.01); *H01R 13/112* (2013.01)

USPC ..... 439/404; 439/320

(58) Field of Classification Search

USPC ..... 439/389–405, 320, 323

See application file for complete search history.

(56) References Cited

U.S. PATENT DOCUMENTS 5,439,388 A * 8/1995 Weiss et al. ..... 439/417
5,599,202 A * 2/1997 Key ..... 439/459

(Continued)

FOREIGN PATENT DOCUMENTS

DE 198 52 489 3/2000
DE 10 2008 019 764 10/2009

(Continued)

OTHER PUBLICATIONS

International Search Report issued in PCT/EP2011/059313 on Aug. 25, 2011.

(Continued)

*Primary Examiner* — Thanh Tam Le

(74) *Attorney, Agent, or Firm* — DLA Piper LLP (US)

(57) ABSTRACT

Systems and methods are disclosed relating to an electric distributor device for connecting to at least one cable, comprising a guide device, a connection part, and a coupling nut for screwing onto the connection part. According to one illustrative implementation, the guide device may have a cable holder part for holding several cable end regions, each having at least one conductor and a conductor guide part for guiding the conductors by means of conductor guiding structures, wherein the insulation displacement connector device has a number of crimping clamps corresponding to the number of cables and each of the connectors is electrically connected to an assigned connection element. Here, for example, when the coupling nut which overlaps the guide device, is screwed onto the connection part, the conductor insulation of the conductors that run in the guide device may be severed by the crimping clamps.

18 Claims, 3 Drawing Sheets

(56) References Cited

U.S. PATENT DOCUMENTS

Figure 1:
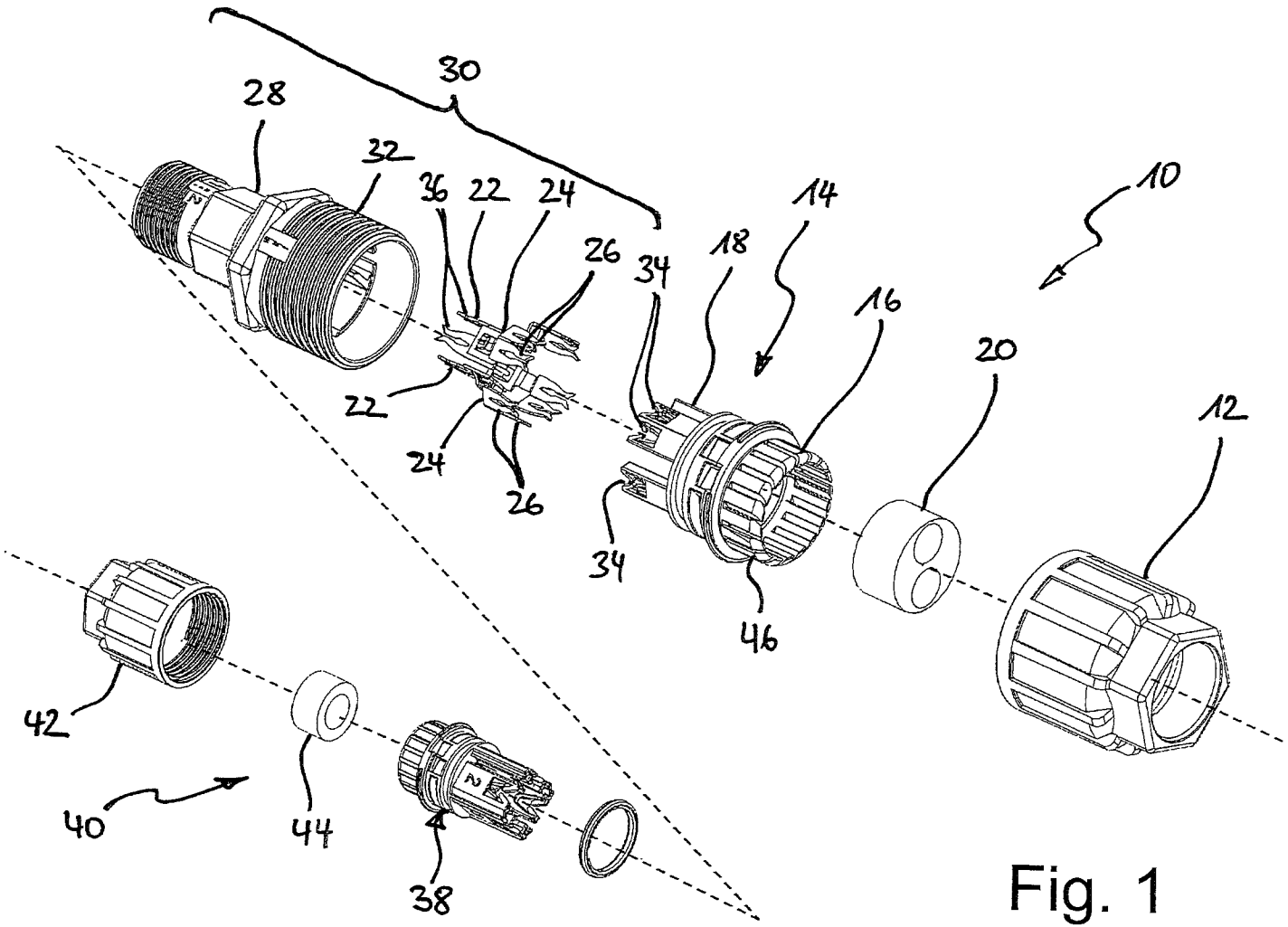

| | | | | |
|---|---|---|---|---|
| 5,662,492 | A * | 9/1997 | Weiss | 439/404 |
| 5,989,056 | A | 11/1999 | Lange et al. | |
| 6,113,420 | A * | 9/2000 | Harting et al. | 439/459 |
| 6,280,229 | B1 * | 8/2001 | Harting et al. | 439/393 |
| 6,364,690 | B1 * | 4/2002 | Nehm-Engelberts | 439/412 |
| 6,443,756 | B1 * | 9/2002 | Hagmann et al. | 439/402 |
| 6,544,067 | B2 * | 4/2003 | Hagmann | 439/404 |

FOREIGN PATENT DOCUMENTS

| | | |
|---|---|---|
| JP | U1981-097878 | 8/1981 |
| JP | U1990-065870 | 5/1990 |
| JP | 11-510306 | 9/1999 |

OTHER PUBLICATIONS

English Language Abstract of DE 10 2008 019 764 published Oct. 12, 2009.

English Language Abstract of DE 198 52 489 published Mar. 30, 2000.

Office Action in related Japanese application No. 2013-513565, dated May 7, 2014, 3 pgs.

* cited by examiner

ELECTRIC DISTRIBUTOR DEVICE

CROSS-REFERENCE TO RELATED APPLICATIONS

This application is a National Stage of International Application No. PCT/EP2011/059313, filed Jun. 6, 2011, published as WO2011/154365, which, in turn, claims the benefit of German Patent Application No. 10 2010 017 266.9, filed Jun. 7, 2010, which are incorporated herein by reference in entirety.

The invention relates to an electric distributor device for connecting to at least one cable, comprising a guide device, a connection part, and a coupling nut for screwing onto the connection part, the latter having at least one connection element and at least one insulation displacement connector that is electrically connected to the connection element.

Distributor devices exist for the transmission of electrical signals or electric power from a machine or system to several other machines or systems. These distribution devices consist of, for example, a form of a distributor for connection to electric distribution lines or as connectors to plug-in cable and/or connector devices. The distributor is constructed, for example, as a T-connector (Y-connector) or as an H-piece.

Distributor systems and/or distribution devices as Y- or H-connectors are available in various forms. These are, for example, the cable connector, which however has a completely separate cable inlet. The IDC (Insulation Displacement Connector) components of this distribution device are individual insulation displacement connectors.

According to DE 10 2008 019 764 A1, a distribution system is made consisting of an electric distributor formed by an H-piece and screwed into the cable connectors. This guide device, cable holder and coupling nut to screw on the connector are, in the respective cable connectors, formed with the components for the distribution function of the distribution device via a separate/separable H-piece.

However, due to the multiple cable connectors and the many disparate distributor components and a comparatively large amount of space, such a distribution system needs to have a very flexible configuration on the basis of the "modular concept".

The invention therefore has the task of creating an alternative distribution device which is compact, has few parts to assemble, and yet remains simple.

The object is achieved according to the invention by the features of independent claim 1. Advantageous embodiments of the invention are specified in the subclaims.

Provided for in the invented distributor device is the guide device with a cable holder part for holding several cable end regions, each having at least one conductor and a conductor guide part for guiding the conductors by means of conductor guide structures, wherein the insulation displacement connector device has a number of insulation displacement connectors corresponding to the number of cables, each of the connectors is electrically connected to an assigned element, is screwed onto the connection part, and when the coupling nut which overlaps the guide device is screwed onto the connecting part, the conductor insulation of the conductors that run in the guide device is severed by the crimping clamps. The distributor device is constructed such that its outer shape corresponds to a cable connection device, such as a cable connector for connecting several cables, but internally has the electrical wiring of a distributor device. In this way, at least one insulation displacement device is formed as a multiple-IDC-contact IDC: Insulation Displacement Connector—which is a connection by insulation displacement). By this integration of the distribution function into a cable connection device for several cables the number of components is reduced and a compact design is achieved. The connector part is a particular plug connector with a finger-safe connecting element.

An advantage provided is that an insulation displacement connector is the connecting element. The connecting element is therefore available already pre-designed for incorporation into the connector in a particularly simple design. It exists, for example, between a terminal and the insulation displacement connector.

According to a preferred embodiment of the invention, it provides for the integration of the crimping clamp into the insulation displacement connectors.

According to another preferred embodiment of the invention, it provides that the connection element is formed as an integral connection element. This may be formed, for example, as a bending punched part.

In particular, it is provided that the distributor device comprises a seal for inclusion in the cable holder part, wherein this seal has a number of apertures corresponding to the maximum number of cables to be connected.

According to another preferred embodiment of the invention, it is provided that cable end regions in the cable holding part can be crimped by this seal when the coupling nut which overlaps the guide device is screwed onto the connection part.

This seal shall then continue to function as a strain relief device.

According to a further advantageous embodiment of the invention, it is provided that the connector comprises a connector body which receives a connection of the connection element and at least a portion of the insulation displacement connector. If the connecting element integrally formed as a connecting element with an insulation displacement connector is present, then it is particularly easy to incorporate into the connector body.

In particular, it is considered that the connecting part has an external thread and the nut has an internal thread, wherein the thread for screwing the coupling nut matches with the connection element.

According to a further advantageous embodiment of the invention, it is provided that the connecting part can be in particular permanently connected to a device, a plug and/or a compatible cable connection device. Preferably, the connector part further includes a locking nut, such as a coupling nut, to fix the connection to the device, the connector, or to the cable terminal connector.

Finally, it is advantageously provided that the distributor device is designed as Y-distribution device for two cables, wherein the insulation displacement connector has two insulation displacement terminals. The insulation displacement connector is formed as a double-IDC interface that performs the Y-distribution function. The corresponding seal is a double seal. This is, for example, substantially in a cylindrical shape with two aligned openings parallel to the cylinder axis of the cylinder form (holes),
which is equivalent to the outer diameter of the corresponding cable diameter.

Figure 2:
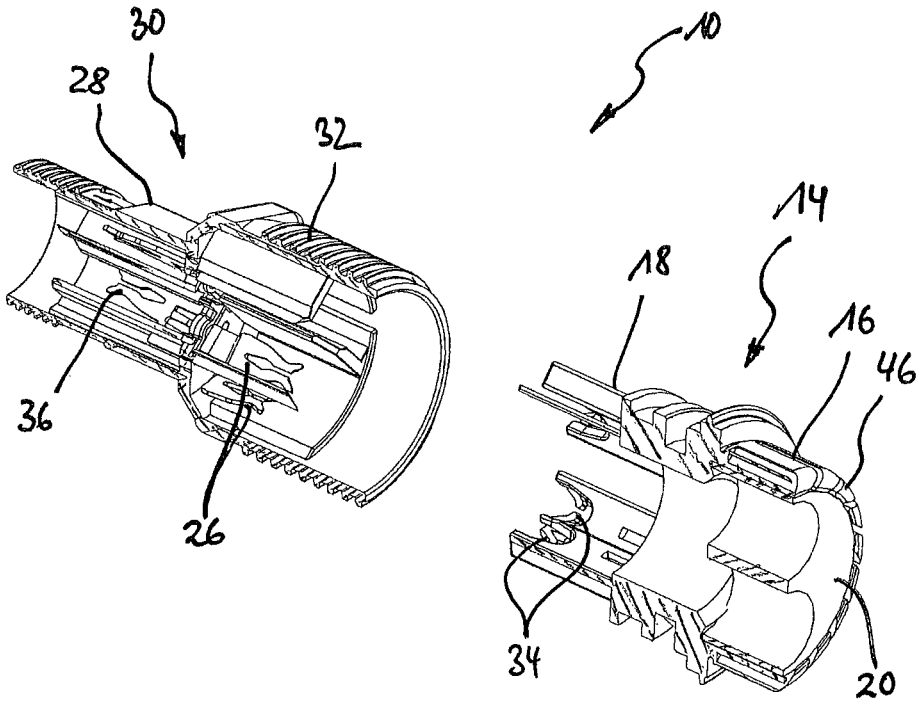
Figure 3:
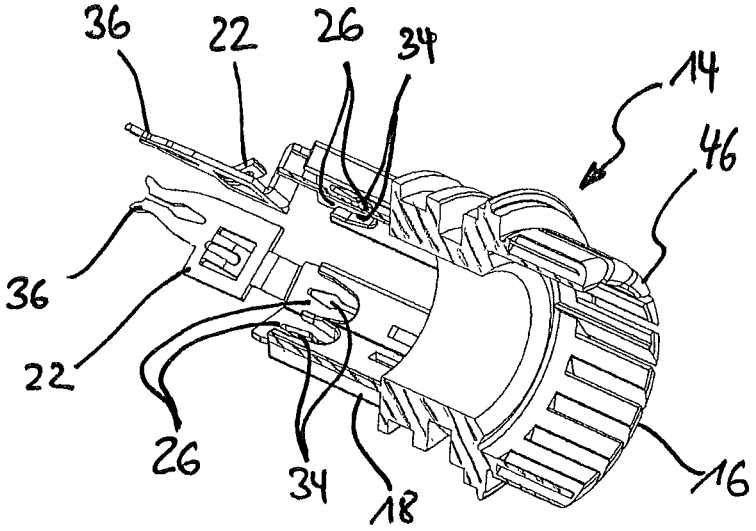

The invention is further explained in more detail with reference to the accompanying drawings and with reference to preferred embodiments. In the drawings:

FIG. 1 an exploded perspective view of an electrical distributor device with a guide device, the coupling nut and connecting part according to a preferred embodiment of the invention, FIG. 2 a perspective view of the cut components of the guide device with double seal and cut connection parts of the distributor device of FIG. 1 and FIG. 3 is a perspective view of the cut guide device with connection elements of FIG. 1.

FIG. 1 shows one form of a Y-shaped cable-distributor device assembly 10 in exploded view. The distributor device 10 includes a coupling nut 12, a guide device 14 with cable holder part 16 and conductor guide part 18, one as a double seal for two cable terminals 20 for insertion into the cable holder part 16 of the guide device 14, four connection elements 22, which are connected to the cables to be connected and the guide device 14 on their facing sides are each connected to a two insulation displacement connectors 26 with insulation displacement connector device 24, and a terminal body 28, which together with the connection body 28 disposed connecting elements 22 and insulation displacement connector 24, forms a connecting part 30. The connection body 28 further comprises an internal thread (not shown) to the corresponding external thread 32 of coupling nut 12.

The conductor guide device 18 has the lead and direction of the conductor ends of the conductors in front of the assembly of the guide device 14 and connection part 30 with eight paired conductor guide structures 34. Each two of the eight paired conductor guide structures 34 are a corresponding pair of cutting clamps 26 and assigned one of the four insulation displacement connectors 24. Each of the Insulation displacement connector 24 is part of the connection element 22 in this integrally formed embodiment. The four connections of the connector elements are themselves formed as other cutting clamps 36, which combine in a guide device 38 with a cable connection device 40 for a single cable. This cable connecting device 40 is known as such. This is, in turn, next to the guide device 38 also on a coupling nut 42 and a ring seal 44.

FIG. 2 shows the guide device 14 and the connection part 30 of the distributor device 10 in standard sectional view. The guide device 14 is, as stated, in the longitudinal direction of the cable holder part 16 and the subsequent conductor guide device 18 with paired conductor guide structures 34. The guide device 14 is formed in the longitudinal direction, also substantially aligned along the longitudinal axis 38 as a hollow cylinder.

The cable holder part 16 has several circumferentially arranged slats 46, which may be present on the inside of seal 20 as shown in FIG. 2. The slats 46 act upon the inner side of the threading for the coupling nut 12 together as a so-called Pg-screw, so that upon when screwing the coupling nut 12 onto the connection part 30, the slats 46 are pressed against the seal 20, thereby sealing the cable end region outside. At the same time, this arrangement acts as a strain relief for the two cables.

It results in the following function of the arrangement of the paired conductor guide structures 34 of the conductor guide device 18 and the insulation displacement connectors 24, each with two insulation displacement connectors 26: Both cable end regions are inserted and threaded through the cable holder part 16 via the seal apertures, so that the cable conductors thread into the interior of the guide device 14 and reach into their conductor guide part 18. There, the conductors are radially bent outwards and into the recesses formed by the guide structures 36, in each case one conductor of one of the two cables in one of the pairs of conductor guide structures 34 and any one conductor of the other of the two cables is inserted in the other conductor guide structure 34 of the respective pair. The conductor guide structures 34 serve as restraint locks for the conductor ends.

In this configuration, any one conductor guide structure pair inserted in the conductor guide structures 34 crosses the slats 24 of a common insulation displacement connector 24 of the connection part 30, which when the coupling nut 12 is screwed onto the connection part 30 cuts the conductor insulation and then connects with the head of the conductor via the insulation displacement connector 24. Since the crimping clamps 26 are inside the insulation displacement connectors 24 and/or connection elements 22, the distributor function of the distributor device 10 takes place at this point.

The circularly arranged connection elements 22 are designed to be inserted from the compact plug-in area in the connector body 30 to the larger connection region in the core guide part 18. The connection elements 22 with crimping clamps 26 (IDC contacts) are still locked in the connection body 28 and remain in place for wiring and incorporation.

By means of the other crimping clamps 36, the connection element 22 closes an electronic connection from the facing side of the guide device 14 to other cables of the lines of the conductors of the connection elements 22 of the cable connection device 40.

Thus, in FIGS. 1 to 3, the displayed arrangement of distributor device 10 and cable connecting device 40, a Y-splitter device (T-distributor device) is connected to three cables.

Alternatively to the arrangement shown, the distributor device 10 may also serve to connect these to an electrical device, a plug, or the like.

For guiding the crimping clamps 34 inside the conductor guide device 18 to the position in which each inserted conductor is held by the conductor guide structure 34, the corresponding crimping clamp 26 is engaged in a guide structure of the conductor guide device 18. FIG. 3 shows a sectional view of the guide device 14 with crimping clamp inserted into the guide structure (not shown) of connection element 22

The result is the following function:

For connection of both cables inserted in the cable holder part 16 of the distributor device 10, they are stripped at a certain length. Then the two end regions of both cables are inserted until they stop in the guide device 14, wherein each conductor is positioned according to the wiring diagram in conductor guide part 18 and cut flush using a tool (such as a standard side cutter). Then the whole assembly is placed into a preferably polarity-shielded connection part 30 and the coupling nut 12 is tightened with a predetermined torque. Here the wiring of the connection of the connecting elements 22 takes place, as well as the sealing and cable strain relief, which are held in turn in a standard cable bracket.

This results in the following benefits:

1. Each of the electrical devices to be connected requires only one outlet for the distributor device 10. The last device in a row can be connected with a standard cable connection device (for example, corresponding to cable connection device 40). By setting a seal of one of both (cable inlet) apertures of the seal 20 it allows the distributor device 10 also to be connected with just one cable.

2. In the exchange of electrical devices, the energy distribution is not interrupted.

3. To connect two cables there only has to be parent (i.e., the coupling nut 12). This saves time and money.

4. The physical energy distribution takes place in the distributor device 10, outside the electrical devices.

As a result, the devices are cheaper and they are not subject to contact heating.

5. The assembly of the distributor device 10 is device independent and can be conveniently performed within any spot in the range of the reach radius of the cable. If the total length of the installation is straightforward, then entire energy distributor can also be pre-assembled and only needs to be plugged in on site.

6. The constructive design of the distributor device 10 is minimal compared to other technical solutions, so therefore the total cost for energy distribution will be considerably cheaper.

LIST OF REFERENCE NUMBERS

Distributor device 10
Coupling nut 12
Guide device 14
Cable holder part 16
Conductor guide part 18
Seal 20
Connection element 22
Insulation displacement connector 24
Crimping clamp 26
Connector body 28
Terminal part 30
External thread 32
Conductor guide structure 34
Insulation displacement connectors, other 36
Guide device, other 38
Cable connector device 40
Coupling nut, other 42
Ring seal 44
Slats 46

The invention claimed is:

1. An electric distributor device for connecting to cables, comprising a guide device, a connection part and a coupling nut for screwing onto the connection part, wherein the connection part has at least one connection element and at least one insulation displacement connector, the insulation displacement connector being electronically connected with the connection element, wherein the guide device has a cable holder part for holding several cable end regions each having at least one conductor and a conductor guide part for guiding the conductors via conductor guiding structures, wherein the insulation displacement connector has a quantity of several crimping clamps corresponding to a quantity of the cables holdable to the cable holder part, the crimping clamps being integrated together with the insulation displacement connector, wherein each crimping clamp is electrically connected to the connection element, and when screwing the coupling nut onto the guide device, conductor insulation of each of the conductors running in the guide device is cut by an associated crimping clamp.

2. The distributor device according to claim 1, wherein the connection element comprises the insulation displacement connector.

3. The distributor device according to claim 1, wherein the connection element is formed as an integral connection element.

4. The distributor device according to claim 1, wherein a seal is included in the cable holder part, which has a number of apertures corresponding to the maximum number of cables to be connected.

5. The distributor device according to claim 4, wherein upon screwing the coupling nut for the guide device onto the connection part, the cable end regions in the cable holder part are clamped by the seal.

6. The distributor device according to claim 1, wherein the connection part comprises a connector body that is connected with the connection element and at least part of the insulation displacement connector.

7. The distributor device according to claim 1, wherein the connection part has an external thread and the coupling nut has an internal thread, wherein the internal thread for screwing the coupling nut matches with the external thread on the connection part.

8. The distributor device according to claim 1, wherein the connection part is arranged to permanently connected to a device, a plug or a cable connection device.

9. The distributor device according to claim 1, wherein the device is embodied as a Y-distribution device for two cables where the insulation displacement connector has two crimping clamps.

10. The distributor device according to claim 2, wherein the connection element is integrally formed with the crimping clamps.

11. The distributor device according to claim 3, wherein a seal is included in the cable holder part, which has a number of apertures corresponding to the maximum number of cables to be connected.

12. The distributor device according to claim 11, wherein upon screwing the coupling nut for the guide device onto the connection part, the cable end regions in the cable holder part are clamped by the seal.

13. The distributor device according to claim 5, wherein the connection part comprises a connector body that is connected with the connection element and at least part of the insulation displacement connector.

14. The distributor device according to claim 5, wherein the connection part has an external thread and the coupling nut has an internal thread, wherein the internal thread for screwing the coupling nut matches with the external thread on the connection part.

15. The distributor device according to claim 6, wherein the connection part is arranged to be permanently connected to a device, a plug or a cable connection device.

16. The distributor device according to claim 7, wherein the device is embodied as a Y-distribution device for two cables where the insulation displacement connector has two crimping clamps.

17. The distributor device according to claim 16, wherein a seal is included in the cable holder part, which has a number of apertures corresponding to the maximum number of cables to be connected.

18. The distributor device according to claim 17, wherein upon screwing the coupling nut for the guide device onto the connection part, the cable end regions in the cable holder part are clamped by the seal.

* * * * *